US010651593B2

(12) United States Patent
Wu et al.

(10) Patent No.: US 10,651,593 B2
(45) Date of Patent: May 12, 2020

(54) QUICK-LOCKING COAXIAL CONNECTOR

(71) Applicant: CommScope Technologies LLC, Hickory, NC (US)

(72) Inventors: Jianping Wu, Jiangsu (CN); Hongjuan An, Jiangsu (CN); Jien Zheng, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 10 days.

(21) Appl. No.: 15/995,806

(22) Filed: Jun. 1, 2018

(65) Prior Publication Data

US 2019/0020149 A1 Jan. 17, 2019

(30) Foreign Application Priority Data

Jul. 12, 2017 (CN) ..... 2017 1 0563316

(51) Int. Cl.
*H01R 13/623* (2006.01)
*H01R 13/627* (2006.01)
(Continued)

(52) U.S. Cl.
CPC ..... *H01R 13/623* (2013.01); *H01R 13/15* (2013.01); *H01R 13/622* (2013.01);
(Continued)

(58) Field of Classification Search
CPC .. H01R 13/623; H01R 13/15; H01R 13/6275; H01R 13/6277; H01R 13/46; H01R 24/40; H01R 9/05; H01R 24/38
(Continued)

(56) References Cited

U.S. PATENT DOCUMENTS 2,728,895 A 12/1955 Quackenbush et al.
4,690,494 A 9/1987 Hirose et al.
(Continued)

FOREIGN PATENT DOCUMENTS

CN 2750499 1/2006
CN 101170232 4/2008
(Continued)

OTHER PUBLICATIONS

Extended European Search Report corresponding to European Application No. 14882519.3, dated Aug. 30, 2017.
(Continued)

*Primary Examiner* — Travis S Chambers
(74) *Attorney, Agent, or Firm* — Myers Bigel, P.A.

(57) ABSTRACT

A quick-locking male connector includes: an inner contact; an insulator; an outer contact; a spring basket with a plurality of spring fingers; an elastic claw with at least radially-inward one tooth and a radially-outward nub; a connector body attached to the outer contact; and a coupling nut having at least one radially-inward extending nub. The coupling nut is movable between a rear unsecured position, in which the nub of the coupling nut is rearward of the nub of the claw, and a forward secured condition, in which the nub of the coupling nut engages the nub of the claw and forces the at least one tooth of the claw radially inward to engage with a thread of an outer conductor body of a mating female connector. The spring fingers of the spring basket apply radially-outward pressure to the outer conductor body of the mating female connector.

15 Claims, 6 Drawing Sheets

(51) Int. Cl.

| | |
|---|---|
| ***H01R 13/15*** | (2006.01) |
| ***H01R 13/622*** | (2006.01) |
| *H01R 13/46* | (2006.01) |
| *H01R 24/40* | (2011.01) |

(52) U.S. Cl.
CPC ..... *H01R 13/6275* (2013.01); *H01R 13/6277* (2013.01); *H01R 13/46* (2013.01); *H01R 24/40* (2013.01)

(58) Field of Classification Search
USPC ..... 439/345, 253–257, 578
See application file for complete search history.

(56) References Cited

U.S. PATENT DOCUMENTS

| | | | | |
|---|---|---|---|---|
| 4,697,859 | A * | 10/1987 | Fisher, Jr. | H01R 13/6315 439/246 |
| 4,966,560 | A | 10/1990 | Marzouk | |
| 5,281,167 | A | 1/1994 | Le et al. | |
| 5,938,474 | A | 8/1999 | Nelson | |
| 6,267,612 | B1 | 7/2001 | Arcykiewicz et al. | |
| 6,471,545 | B1 | 10/2002 | Hosler, Sr. | |
| 6,619,876 | B2 | 9/2003 | Vaitkus et al. | |
| 6,709,289 | B2 | 3/2004 | Huber et al. | |
| 6,786,767 | B1 | 9/2004 | Fuks et al. | |
| 6,824,415 | B2 | 11/2004 | Wlos | |
| 7,032,931 | B2 | 4/2006 | Austin | |
| 7,131,868 | B2 | 11/2006 | Montena | |
| 7,513,788 | B2 * | 4/2009 | Camelio | H01R 13/6277 439/352 |
| 7,527,524 | B1 | 5/2009 | Coleman et al. | |
| 7,635,283 | B1 | 12/2009 | Islam | |
| 7,731,529 | B1 | 6/2010 | Islam | |
| 7,785,144 | B1 | 8/2010 | Islam | |
| 7,850,472 | B2 * | 12/2010 | Friedrich | H01R 13/506 439/256 |
| 7,914,311 | B1 | 3/2011 | Gallusser et al. | |
| 7,972,158 | B2 * | 7/2011 | Wild | H01R 13/6277 439/257 |
| 8,408,938 | B2 | 4/2013 | Proeckl | |
| 8,506,325 | B2 | 8/2013 | Malloy et al. | |
| 8,764,473 | B2 | 7/2014 | Komatsubara | |
| 9,024,191 | B2 | 5/2015 | Paynter et al. | |
| 9,108,348 | B2 | 8/2015 | Van Swearingen et al. | |
| 9,306,346 | B2 | 4/2016 | Vaccaro et al. | |
| 9,484,645 | B2 | 11/2016 | Matzen | |
| 9,559,458 | B2 | 1/2017 | Zhang et al. | |
| 9,692,191 | B2 | 6/2017 | Tatzel et al. | |
| 2004/0067675 | A1 | 4/2004 | Heebe et al. | |
| 2005/0118865 | A1 | 6/2005 | Henningsen | |
| 2007/0049113 | A1 | 3/2007 | Rodrigues et al. | |
| 2007/0087612 | A1 | 4/2007 | Tsujita | |
| 2010/0199493 | A1 | 8/2010 | Chansrivong | |
| 2011/0130048 | A1 | 6/2011 | Haunberger et al. | |
| 2012/0255991 | A1 | 10/2012 | Swearingen | |
| 2013/0084738 | A1 | 4/2013 | Van Swearingen et al. | |
| 2013/0157487 | A1 | 6/2013 | Heebe et al. | |
| 2014/0148044 | A1 | 5/2014 | Balcer et al. | |
| 2015/0024628 | A1 | 1/2015 | Haegele et al. | |
| 2015/0118897 | A1 | 4/2015 | Paynter et al. | |
| 2015/0200469 | A1 * | 7/2015 | Vaccaro | H01R 13/24 439/578 |

FOREIGN PATENT DOCUMENTS

| | | |
|---|---|---|
| FR | 2478882 | 9/1981 |
| JP | H11354219 | 12/1999 |
| JP | 2008198605 | 8/2008 |

OTHER PUBLICATIONS

International Search Report or corresponding PCT Application No. PCT/CN2014/071971, dated Nov. 18, 2014.
Notification of Transmittal of the International Search Report and the Written Opinion of the International Searching Authority, or the Declaration for corresponding PCT Application No. PCT/US2017/057109, dated Jan. 26, 2018.
International Search Report and Written Opinion of the International Searching Authority, International Application No. PCT/US2018/041352, dated Nov. 16, 2018, 13 pages.

* cited by examiner

QUICK-LOCKING COAXIAL CONNECTOR

RELATED APPLICATION

This application claims priority from Chinese Application No. 201710563316.5 filed Jul. 12, 2017, the disclosure of which is hereby incorporated herein in its entirety.

FIELD OF THE INVENTION

The present invention relates to the field of cable connection, especially to the field of coaxial cable connection.

BACKGROUND

In current telecommunication markets, thread-coupling mechanisms are often used, to connect two coaxial cables. Male and female connectors are attached to respective coaxial cables, and the end of the female connector is connected with the threaded end of the male connector.

Thread-coupling mechanisms distinguish themselves by their high mechanical strength, durability, and reliability; however, there are some known disadvantages. Interconnection involves matching the threads of the male and female connectors (which may take a certain amount of time to align); after matching the threads of the male and female connectors, the male and female connectors can be rotated to be tightened. Typically, several rotations are needed to tighten the threads of the male and female connectors to achieve a stable connection; thus, installation and removal may be cumbersome. Moreover, in some circumstances space is quite limited, which increases the difficulty of aligning and rotating the connectors.

To address the above issues, a SNAP-N interface has been developed. However, this design requires a special female connector to achieve the connection, which can add cost. Also, it can suffer from unreliability and looseness, which in turn can impact the characteristics of high-frequency performance.

U.S. Pat. No. 9,559,458, which is incorporated herein by reference in its entirety, discusses a quick-lock interface shown in FIGS. 1 and 2. A male connector 1 includes an inner contact 9, an insulator 2, an outer contact 3 that is in contact with a connector body 5, and an annular claw 4 that encircles the outer contact 3. A push nut 8 engages the connector body 5, and a coupling nut 7 engages the push nut 8 and the claw 4. A spring 6 bears against the claw 4 and the push nut 8 and biases the claw 4 forwardly. A female connector 11 (which is a standard SMA-type female connector) includes an inner contact 13, an insulator 15 and an outer conductor body 14 with threads 12 on its outer surface.

When the male connector 1 and the female connector 11 are in the process of being mated (FIG. 1), the outer contact 3 fits within the inner surface of the outer conductor body 14 and bears against a shoulder 14*a* of the outer conductor body 14, and the inner contact 9 is received in a bore in the inner contact 13. These engagements electrically connect (a) the inner contact 9 with the inner contact 13 and (b) the outer contact 3 with the outer conductor body 14. The interconnection is secured by the coupling nut 7 as it moves from an unsecured position (FIG. 1) to a secured position (FIG. 2). More specifically, teeth 43 on the inner surface of the claw 4 are forced by a radially-inward nub 16 on the coupling nut 7 to engage the threads on the outer surface of the outer conductor body 14 to maintain the interconnection of the connectors 1, 11. As shown in FIG. 2, the push nut 8 is forced forwardly relative to the connector body 5 (resisted by the spring 6), to force the coupling nut 7 forward also. The nub 16 on the coupling nut 7 "clears" a radially-outward nub 17 on the outer surface of the claw 4 to secure the claw 4 in place (FIG. 2). Also, because the claw 4 has declining slots 41 that engage teeth 71 on the coupling nut 7, the coupling nut 7 rotates relative to the claw 4 as it moves forwardly. The interconnection can be released by pushing the push nut 8 forward again, which allows the teeth 43 to disengage from the threads on the outer conductor body 14. A more detailed description of the interaction is discussed in the aforementioned U.S. Pat. No. 9,559,458.

SUMMARY

As a first aspect, embodiments of the invention are directed to a quick-locking male connector, comprising: an inner contact; an insulator, wherein the inner contact resides within the insulator; an outer contact, wherein the insulator resides within the outer contact; a spring basket with a plurality of spring fingers, the spring basket abutting a forward end of the outer contact; an elastic claw with at least one radially-inward tooth and a radially-outward nub, wherein the spring basket resides within the claw, and wherein a gap exists between the at least one tooth and the spring fingers; a connector body attached to the outer contact; and a coupling nut having at least one radially-inward extending nub. The coupling nut is movable between a rear unsecured position, in which the nub of the coupling nut is rearward of the nub of the claw, and a forward secured condition, in which the nub of the coupling nut engages the nub of the claw and forces the at least one tooth of the claw radially inward to engage with a thread of an outer conductor of a mating female connector inserted into the gap between the spring fingers and the tooth of the claw. The spring fingers of the spring basket apply radially-outward pressure to the outer conductor of the mating female connector.

As a second aspect, embodiments of the invention are directed to a quick-locking male connector, comprising: an inner contact; an insulator, wherein the inner contact resides within the insulator; an outer contact, wherein the insulator resides within the outer contact; an elastic claw with at least one radially-inward tooth and a radially-outward nub, wherein the spring basket resides within the claw; a connector body attached to the outer contact, the coupling nut including front and rear ridges in a radially outward surface and a recess between the front and rear ridges; and a coupling nut having at least one radially-inward extending nub and rearwardly-extending fingers, the rearwardly-extending fingers including radially-inwardly extending projections. The coupling nut is movable between a rear unsecured position, in which the nub of the coupling nut is rearward of the nub of the claw and the projections are rearward of the rear ridge of the connector body, and a forward secured condition, in which the nub of the coupling nut engages the nub of the claw and forces the at least one tooth of the claw radially inward to engage with a thread of an outer conductor of a mating female connector, and the projections of the coupling nut are positioned in the recess.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
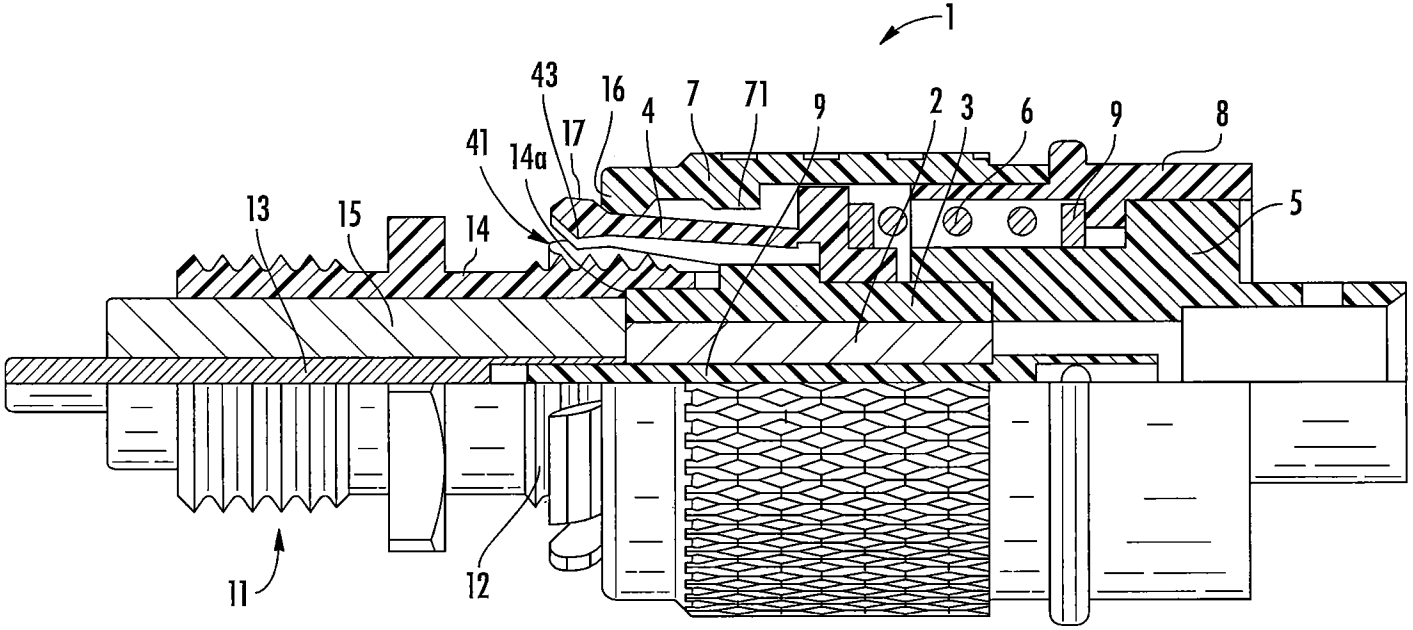
FIG. 1 PRIOR ART
FIG. 1 is a schematic partial cutaway front view of prior art male and female connectors prior to securing.
Figure 2:
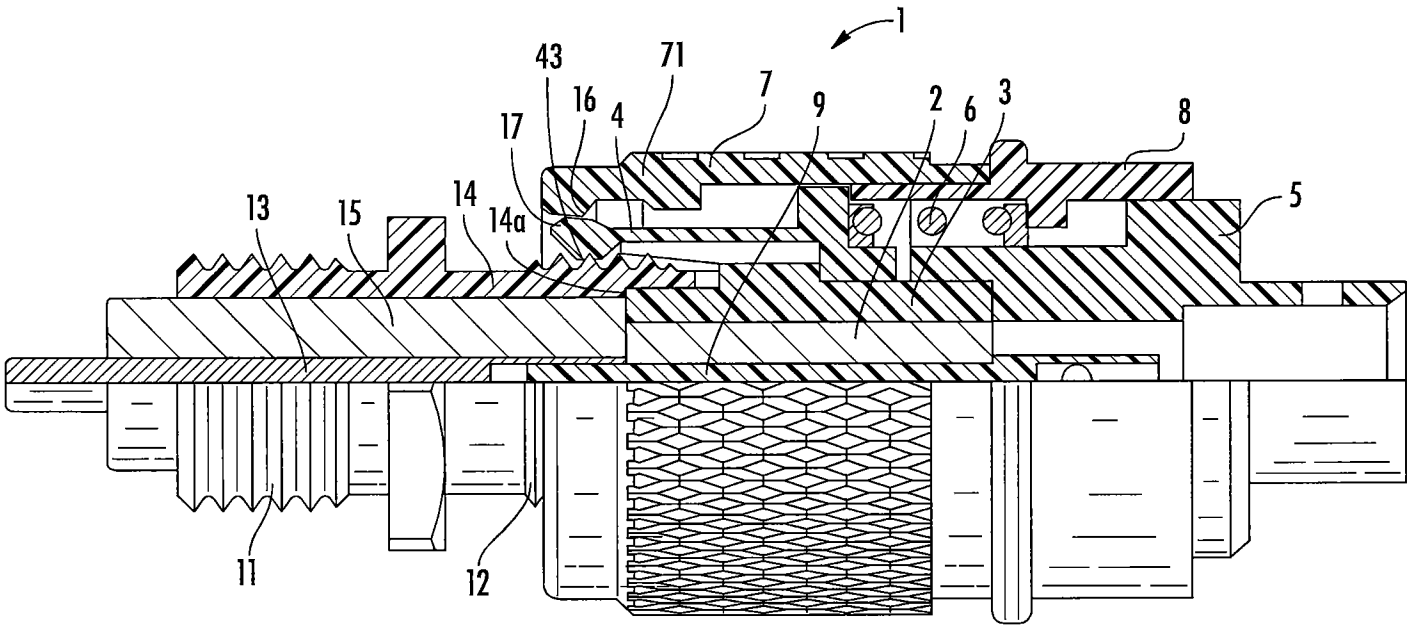
FIG. 2 PRIOR ART
FIG. 2 is a schematic partial cutaway front view of the male and female connectors of FIG. 1 in a secured condition.
Figure 3:
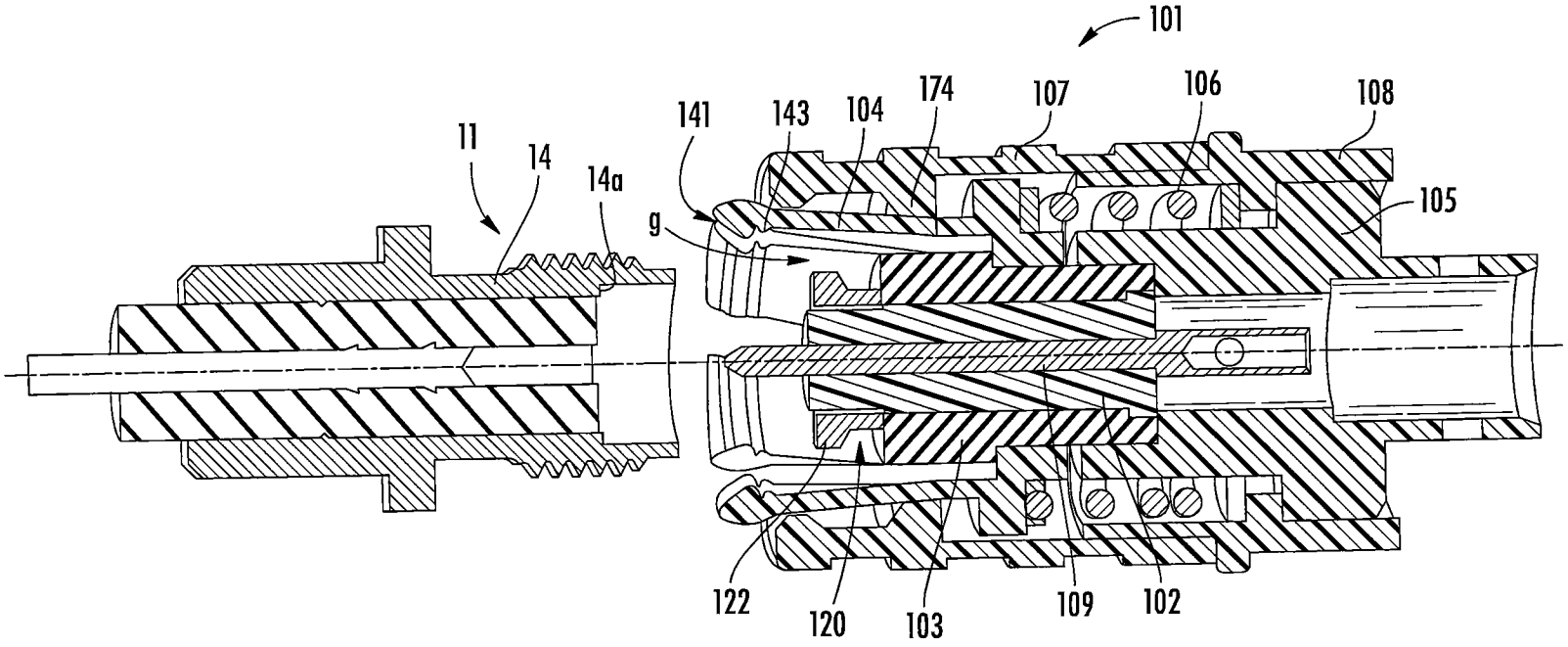
FIG. 3 is a schematic front section view of male and female connectors according to embodiments of the invention in a mated, unsecured condition.
Figure 4:
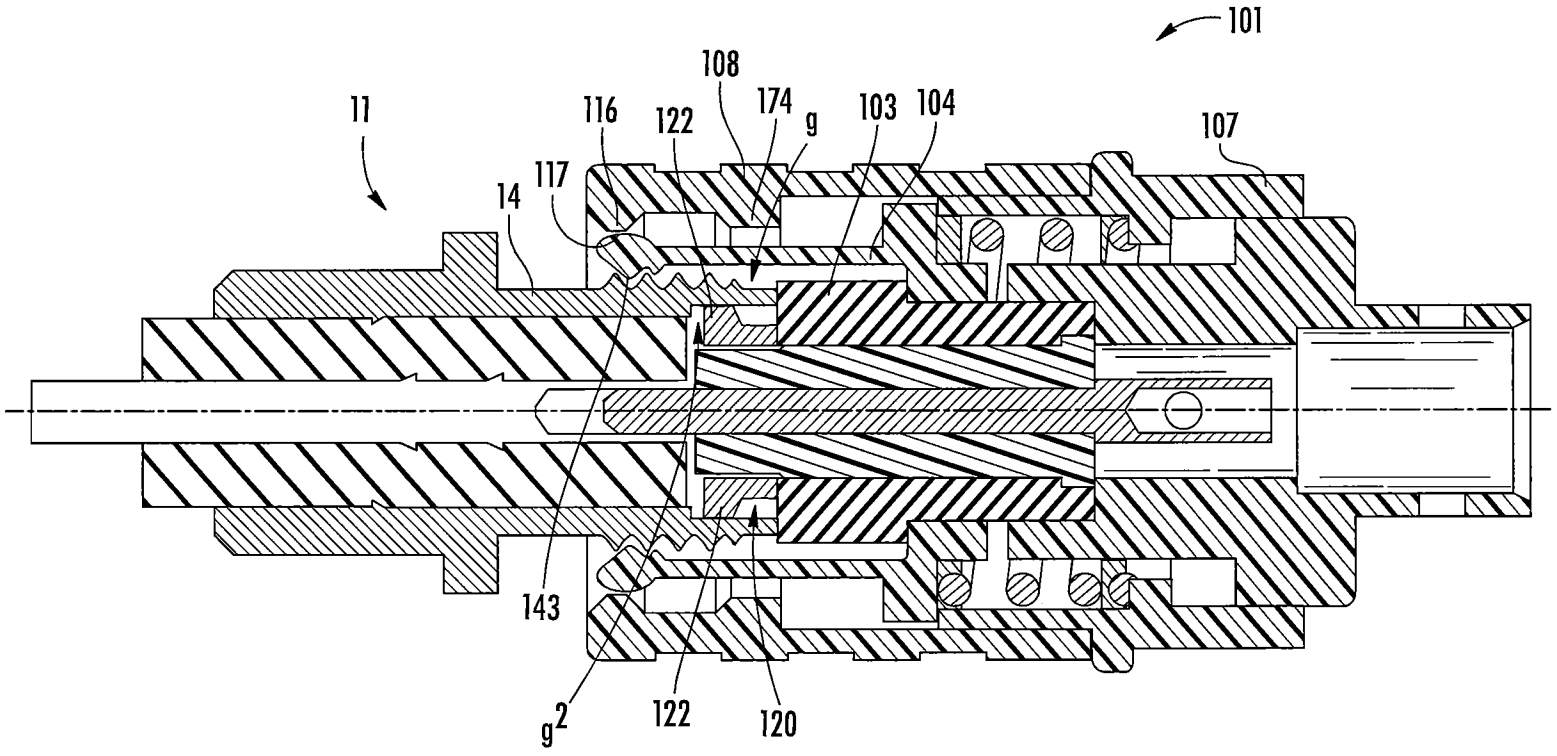
FIG. 4 is a schematic front section view of the male and female connectors of FIG. 3 in a mated, secured condition.

Referring now to FIGS. 3 and 4, a male connector 101 according to embodiments of the invention is shown with a female connector 11 as described above. The male connector 101 is similar in many respects to the male connector 1 described above; it includes an inner contact 109, an insulator 102, an outer contact 103 that is in contact with a connector body 105, an annular claw 104 that encircles the outer contact 103, a push nut 108 that engages the connector body 105, a coupling nut 107 that engages the push nut 108 and the claw 104, and a spring 106 that bears against the claw 104 and the push nut 108. However, the male connector 101 differs from the male connector 1 in that the outer contact 103 extends forwardly a shorter distance than does the outer contact 103, and a conductive spring basket 120 with spring fingers 122 replaces the missing portion of the outer contact 103. As can be seen in FIG. 3, a gap g exists between the spring fingers 122 and the claw 104.

As can be seen in FIG. 4, when the male connector 101 is mated with the female connector 11 (which, again, is a standard SMA-type female connector), the forward edge of the outer conductor 14 contacts the forward surface of the outer contact 103 to provide axial contact (and an axial stop) in much the same manner as described above in connection with the male connector 1. In this position, there is a gap g2 between the free ends of the spring fingers 122 and the shoulder 14*a* of the outer conductor body 14, such that the, outer conductor body 14 exerts no axial force on the spring fingers 122. However, in addition the spring fingers 122 of the spring basket 120 contact the inner surface of the outer conductor body 14 as the outer conductor body 14 fills the gap g and provides radially outward pressure on the outer conductor body 14. As such, the male connector 101 meets the requirements of IEC (46F/243/INP) (hereinafter the 4.3/10 interface), which is alleged to exhibit superior electrical performance and improved (easier) mating. The 4.3/10 interface includes the following, features: (a) separate electrical and mechanical reference planes; and (b) radial (electrical) contact of the outer conductor, so that axial compression is, not needed for high normal forces. The radial contact between the spring fingers 122 and the outer conductor body 14 required by the 4.3.10 interface is intended to improve passive intermodulation (PIM) performance of the interface. As discussed, the presence of the axial stop provided by the outer conductor 14 on the outer contact 103 (rather than having axial contact between the spring fingers 122 and the outer conductor body 14) and the radial contact generated by the spring fingers 122 on the outer conductor body 14 enable the connectors 101, 11 to qualify as a 4.3/10 interface and, accordingly, potentially enjoy improved PIM performance.

Once the male connector 101 is mated with the female connector 11, the mated connectors 101, 11 can be secured in the same manner as described above for the connectors 1, 11: from the unsecured position of FIG. 3, the push nut 108 is pushed forwardly, which forces the nub 116 of the coupling nut 107 past the nub 117 of the claw 104 (also, as described above, the teeth 174 on the coupling nut 107 are received in the declining slots 141 of the claw 104, causing the coupling nut 107 to rotate as it moves forward). The forward movement of the coupling nut 107 results in the teeth 143 of the claw 104 being forced into engagement with the threads of the outer conductor body 14 to secure the interconnection in a secured position, with the coupling nut 107 maintaining the claw 104 in place (FIG. 4). Thus, the male connector 101 not only satisfies the requirements of a 4.3/10 connector, but does so with a quick-lock connection, and also mates with a standard SMA-type female connector. As such, the male connector 101 can provide quick-locking capability in a 4.3/10 connector that is able to be mated with an existing SMA-type connector (for example, the SMA-type female connector may already be present on a piece of existing equipment)

Figure 5:
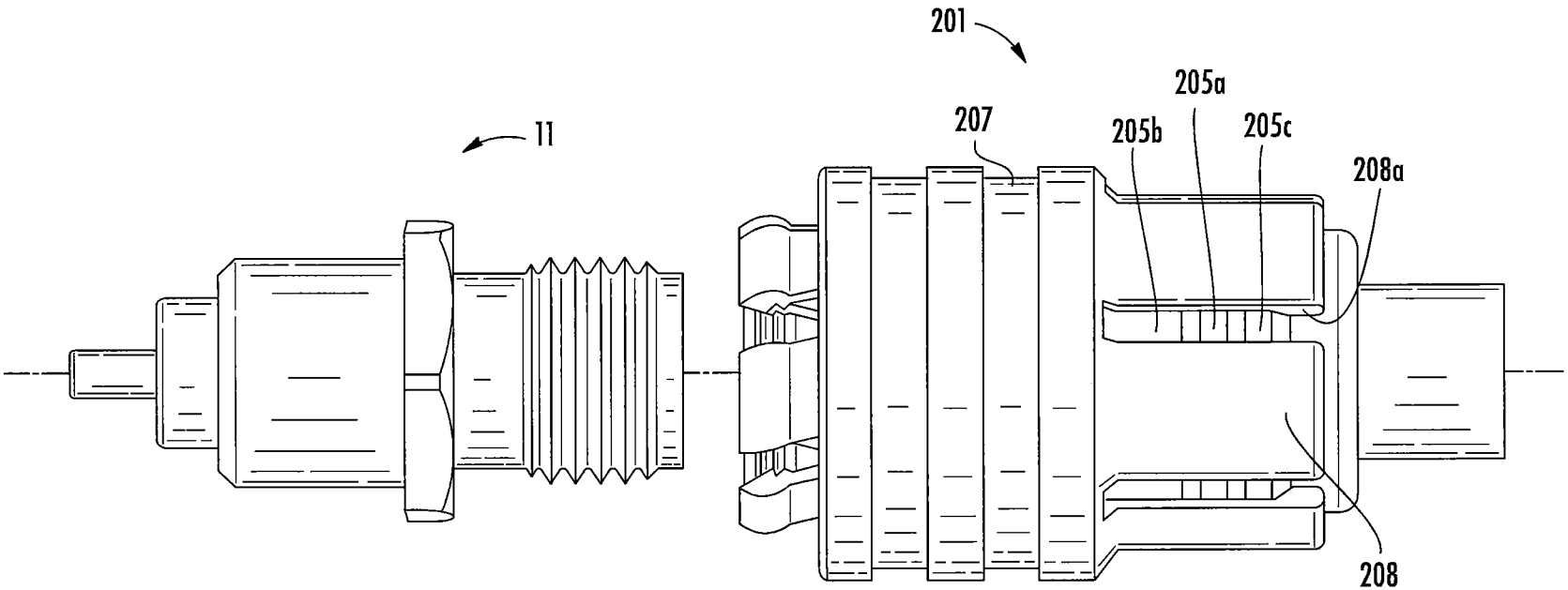
FIG. 5 is a front perspective section view of male and female connectors according to additional embodiments of the invention.
Figure 6:
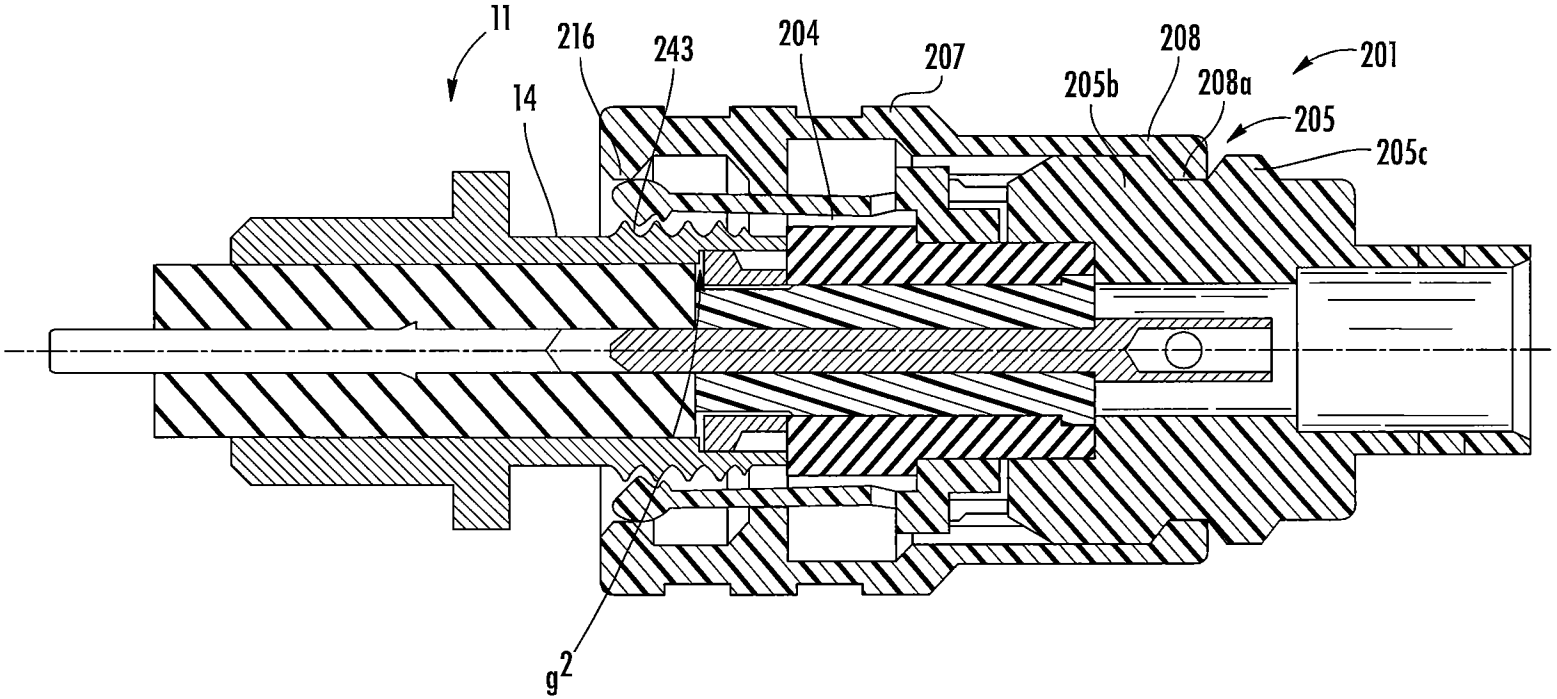
FIG. 6 is a schematic front section view of the male and female connectors of FIG. 5 in a mated, secured condition.

Referring now to FIGS. 5 and 6, another embodiment of a male connector, designated broadly at 201, is illustrated therein with the female connector 11. The male connector 201 is similar to the male connector 101 with the exception that it lacks a separate push nut and spring, and instead relies on resilience in the coupling nut 207 to secure the interconnection of the male connector 201 and the female connector 11. The conductor body 205 of the connector 201 is generally thicker and includes a recess 205*a* in its outer surface surrounded by front and rear ridges 205*b*, 205*c*. The coupling nut 207 includes fingers 208 at its rear end; projections 208*a* extend radially inwardly from the fingers 208.

As can be seen in FIG. 5, in the unsecured condition, the projections 208*a* on the fingers 208 of the coupling nut 207 are positioned rearwardly of the rear ridge 205*c*. When the connector 201 is mated with the female connector 11 as described above in connection with the male connector 101, the interconnection can be secured by pushing the coupling nut 207 forwardly. The ends of the fingers 207 deflect radially outwardly as they travel over the rear ridge 205*c*, then recover radially inwardly so that the nubs 208*a* are received in the recess 205*a*. In this secured position, the nub 216 on the coupling nut 207 is located to force the teeth 243 of the claw 204 into the threads of the outer conductor body 14 (FIG. 6). Thus, like the male connector 101, the male connector 201 can provide quick-locking capability in a 4.3/10 connector that is able to be mated with an existing SMA-type connector (for example, the SMA-type female connector may already be present on a piece of existing equipment).

It should also be recognized that the male connectors 101, 201 may also be employed where NEX10® connectors (which have many similarities in structure to 4.3/10 connectors) may be employed with SMA-type female connectors.

Exemplary materials for the various components of the male and female connectors 1, 101, 201, 11 are discussed in some detail in U.S. Pat. No. 9,559,458, supra. Similarly, some variations of designs, configurations, and operation are discussed in this patent.

In the present specification, the present invention has been described according to the particular embodiments. But it is obvious that these embodiments can be modified or changed without departure from the spirit and scope of the present invention. Therefore, the specification and drawings described above are exemplary only and not intended to be limiting.

The invention claimed is:

1. A quick-locking male connector, comprising:

an inner contact;

an insulator, wherein the inner contact resides within the insulator;

an outer contact, wherein the insulator resides within the outer contact;

a spring basket with a plurality of spring fingers, the spring basket abutting a forward end of the outer contact;

an elastic claw with at least one radially-inward tooth and a radially-outward nub, wherein the spring basket resides within the claw, and wherein a gap exists between the at least one tooth and the spring fingers;

a connector body attached to the outer contact; and a coupling nut having at least one radially-inward extending nub;

wherein the coupling nut is movable between a rear unsecured position, in which the nub of the coupling nut is rearward of the nub of the claw, and a forward secured condition, in which the nub of the coupling nut engages the nub of the claw and forces the at least one tooth of the claw radially inward to engage with a thread of an outer conductor body of a mating female connector inserted into the gap between the spring fingers and the tooth of the claw; and wherein the spring fingers of the spring basket apply radially-outward pressure to the outer conductor body of the mating female connector, wherein the spring fingers have no axial contact with the outer conductor body of the mating female connector.

2. The quick-locking male connector defined in claim 1, wherein the claw includes declining slots, and wherein the coupling nut has radially-inwardly extending teeth received in the declining slots.

3. The quick-lock male connector defined in claim 1, wherein the at least one tooth of the claw is a plurality of teeth.

4. The quick-lock male connector defined in claim 1, wherein the at least one nub of the coupling nut is a plurality of nubs.

5. The quick-lock male connector defined in claim 1, wherein the at least one nub of the claw is a plurality of nubs.

6. The quick-lock male connector defined in claim 1, in combination with an SMA-type female connector.

7. The quick-locking male connector defined in claim 1, further comprising a push nut that encircles the connector body, and wherein forward movement of the push nut moves the coupling nut from the unsecured position to the secured position.

8. The quick-locking male connector defined in claim 7, further comprising a spring that engages the push nut and the claw and biases the claw toward the secured position.

9. A quick-locking male connector, comprising:

an inner contact;

an insulator, wherein the inner contact resides within the insulator;

an outer contact, wherein the insulator resides within the outer contact;

an elastic claw with at least one radially-inward tooth and a radially-outward nub;

a spring basket with a plurality of spring fingers residing within the claw;

a connector body attached to the outer contact, the connector body including front and rear ridges in a radially outward surface and a recess between the front and rear ridges; and a coupling nut having at least one radially-inward extending nub and rearwardly-extending fingers, the rearwardly-extending fingers including radially-inwardly extending projections;

wherein the coupling nut is movable between a rear unsecured position, in which the nub of the coupling nut is rearward of the nub of the claw and the projections are rearward of the rear ridge of the connector body, and a forward secured condition, in which the nub of the coupling nut engages the nub of the claw and forces the at least one tooth of the claw radially inward to engage with a thread of an outer conductor body of a mating female connector, and the projections of the coupling nut are positioned in the recess, wherein the spring fingers have no axial contact with the outer conductor body of the mating female connector.

10. The quick-locking male connector defined in claim 9, wherein the spring basket abuts a forward end of the outer contact; and wherein a gap exists between the spring fingers and a shoulder of the outer conductor body of the mating female connector; and wherein the spring fingers of the spring basket apply radially-outward pressure to the outer conductor body of the mating female connector.

11. The quick-locking male connector defined in claim 9, wherein the claw includes declining slots, and wherein the coupling nut has radially-inwardly extending teeth received in the declining slots.

12. The quick-lock male connector defined in claim 9, wherein the at least one tooth of the claw is a plurality of teeth.

13. The quick-lock male connector defined in claim 9, wherein the at least one nub of the coupling nut is a plurality of nubs.

14. The quick-lock male connector defined in claim 9, wherein the at least one nub of the claw is a plurality of nubs.

15. The quick-lock male connector defined in claim 9, in combination with an SMA-type female connector.

* * * * *